US008898856B2

(12) United States Patent
Ruben

(10) Patent No.: US 8,898,856 B2
(45) Date of Patent: Dec. 2, 2014

(54) DIRT CUP WITH SECONDARY CYCLONIC CLEANING CHAMBERS

(75) Inventor: Brian K. Ruben, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 0 days.

(21) Appl. No.: 13/381,279

(22) PCT Filed: Nov. 9, 2011

(86) PCT No.: PCT/US2011/059913

§ 371 (c)(1),
(2), (4) Date: Dec. 28, 2011

(87) PCT Pub. No.: WO2012/064814

PCT Pub. Date: May 18, 2012

(65) Prior Publication Data

US 2013/0219654 A1 Aug. 29, 2013

Related U.S. Application Data

(60) Provisional application No. 61/411,659, filed on Nov. 9, 2010.

(51) Int. Cl.
*A47L 9/10* (2006.01)
*A47L 9/16* (2006.01)

(52) U.S. Cl.
CPC ..... *A47L 9/1683* (2013.01); *A47L 9/1608* (2013.01); *Y10S 55/03* (2013.01)
USPC ..... 15/347; 15/353; 55/DIG. 3; 55/399; 55/440; 55/459.1

(58) Field of Classification Search
CPC ..... A47L 9/1683
USPC ..... 15/347, 353, 327.1, 327.2; 55/DIG. 3, 55/399, 440, 459.1
See application file for complete search history.

(56) References Cited

U.S. PATENT DOCUMENTS

| | | | | |
|---|---|---|---|---|
| 468,935 | A * | 2/1892 | Morse | 55/399 |
| 814,837 | A * | 3/1906 | Penton | 55/310 |
| 2,010,128 | A * | 8/1935 | Arnold | 209/710 |
| 2,222,930 | A * | 11/1940 | Arnold | 55/339 |
| 2,351,864 | A * | 6/1944 | Linderman, Jr. | 261/79.2 |
| 2,378,600 | A * | 6/1945 | Tongeren | 55/399 |
| 2,542,635 | A * | 2/1951 | Davis et al. | 55/399 |
| 3,399,770 | A * | 9/1968 | Salomon | 209/727 |
| 3,513,642 | A * | 5/1970 | Cornett | 55/399 |
| 3,577,711 | A * | 5/1971 | De Bernardo | 55/399 |
| 5,137,554 | A * | 8/1992 | Carter, Jr. | 55/399 |
| 7,419,522 | B2 * | 9/2008 | Arnold | 55/345 |
| 7,922,794 | B2 | 4/2011 | Morphey | |
| 2005/0066469 | A1 * | 3/2005 | Oh et al. | 15/353 |
| 2005/0138759 | A1 * | 6/2005 | Park et al. | 15/347 |

(Continued)

*Primary Examiner* — Mark Spisich
*Assistant Examiner* — Andrew A Horton
(74) *Attorney, Agent, or Firm* — King & Schickli, PLLC

(57) ABSTRACT

A vacuum cleaner has a body including a nozzle assembly and a handle assembly. A suction generator and a dirt collection vessel are both carried on the body. The dirt collection vessel includes a dirt cup having a side wall and a bottom wall, a tangentially directed inlet in the side wall and an axially directed outlet. An inside surface of the side wall includes ribbing to help remove dirt and debris from the airstream and improve vacuum cleaner performance and efficiency.

17 Claims, 11 Drawing Sheets

(56) References Cited

U.S. PATENT DOCUMENTS

| | | | | |
|---|---|---|---|---|
| 2005/0172585 | A1* | 8/2005 | Oh et al. | 55/345 |
| 2006/0042206 | A1* | 3/2006 | Arnold et al. | 55/424 |
| 2006/0230718 | A1* | 10/2006 | Han et al. | 55/345 |
| 2007/0163073 | A1* | 7/2007 | Sepke et al. | 15/353 |
| 2008/0155948 | A1* | 7/2008 | Smith | 55/346 |
| 2009/0007369 | A1* | 1/2009 | Gomiciaga-Pereda et al. | 15/347 |
| 2009/0300872 | A1* | 12/2009 | Griffith et al. | 15/347 |
| 2009/0300874 | A1* | 12/2009 | Tran et al. | 15/353 |

* cited by examiner

DIRT CUP WITH SECONDARY CYCLONIC CLEANING CHAMBERS

This application is a national stage of International application No. PCT/US11/059913 filed on Nov. 9, 2011, which claims priority to U.S. Provisional Patent Application Ser. No. 61/411,659, filed 9 Nov. 2010, the entire disclosure of which is incorporated herein by reference.

TECHNICAL FIELD

The present document relates generally to the floor care equipment field and, more particularly, to a vacuum cleaner equipped with a dirt cup assembly including a ribbed interior side wall to enhance cleaning efficiency.

BACKGROUND OF THE INVENTION

Floor care appliances including vacuum cleaners equipped with dirt cup assemblies providing cyclonic cleaning action are well known in the art. Examples of such vacuum cleaners may be found in, for example, issued U.S. Pat. Nos. 7,640,624 and 7,908,707 as well as published U.S. Patent Application 2011/0225764 all assigned to the assignee of the present document.

Such cyclonic vacuum cleaners generally include a dirt cup with an arcuate and generally cylindrical sidewall, a tangentially directed air inlet provided in that side wall and an axially directed air outlet provided in an end of the dirt cup. The air outlet is covered with a filter shroud that is concentrically received within the arcuate side wall of the dirt cup.

During operation, air entrained dirt and debris is drawn into the vacuum cleaner and delivered to the dirt cup through the tangentially directed inlet. The air stream swirls around the arcuate sidewall so as to provide cyclonic air flow. Particles in the air stream act under centrifugal force and are accelerated toward engagement with the side wall with the resulting friction slowing the particles so that they drop downwardly toward the bottom of the dirt cup where they are collected. Relatively clean air is then drawn through the filter shroud and discharged through the axially directed outlet.

This document describes a vacuum cleaner having a dirt cup assembly with an arcuate sidewall incorporating ribs that function to enhance the cleaning efficiency of the vacuum cleaner.

SUMMARY OF THE INVENTION

A vacuum cleaner comprises a body including a nozzle assembly and a handle assembly. A suction generator and a dirt collection vessel are both carried on the body. The dirt collection vessel includes a dirt cup having a side wall and a bottom wall, a tangentially directed inlet in the side wall and an axially directed outlet. An inside surface of the side wall includes ribbing. The ribbing may extend parallel to the bottom wall, perpendicular to the bottom wall or helically between the tangentially directed inlet and the bottom wall.

Still further, a shroud covers the axially directed outlet. The shroud is concentrically received within the side wall. The shroud includes a skirt. In one possible embodiment, ribbing is provided on the side wall from a point opposite the skirt to the bottom wall of the dirt cup. That ribbing may have a cross sectional profile of wave shape, curl shape, wall shape, plateau shape or cove shape.

In the following description there is shown and described several different embodiments of a novel vacuum cleaner.

Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the vacuum cleaner and the dirt collection vessel and together with the description serve to explain certain principles of the devices. In the drawings.

Reference will now be made in detail to the present preferred embodiments of the invention, examples of which are illustrated in the accompanying drawings.

DETAILED DESCRIPTION OF THE DEVICE

Figure 1:
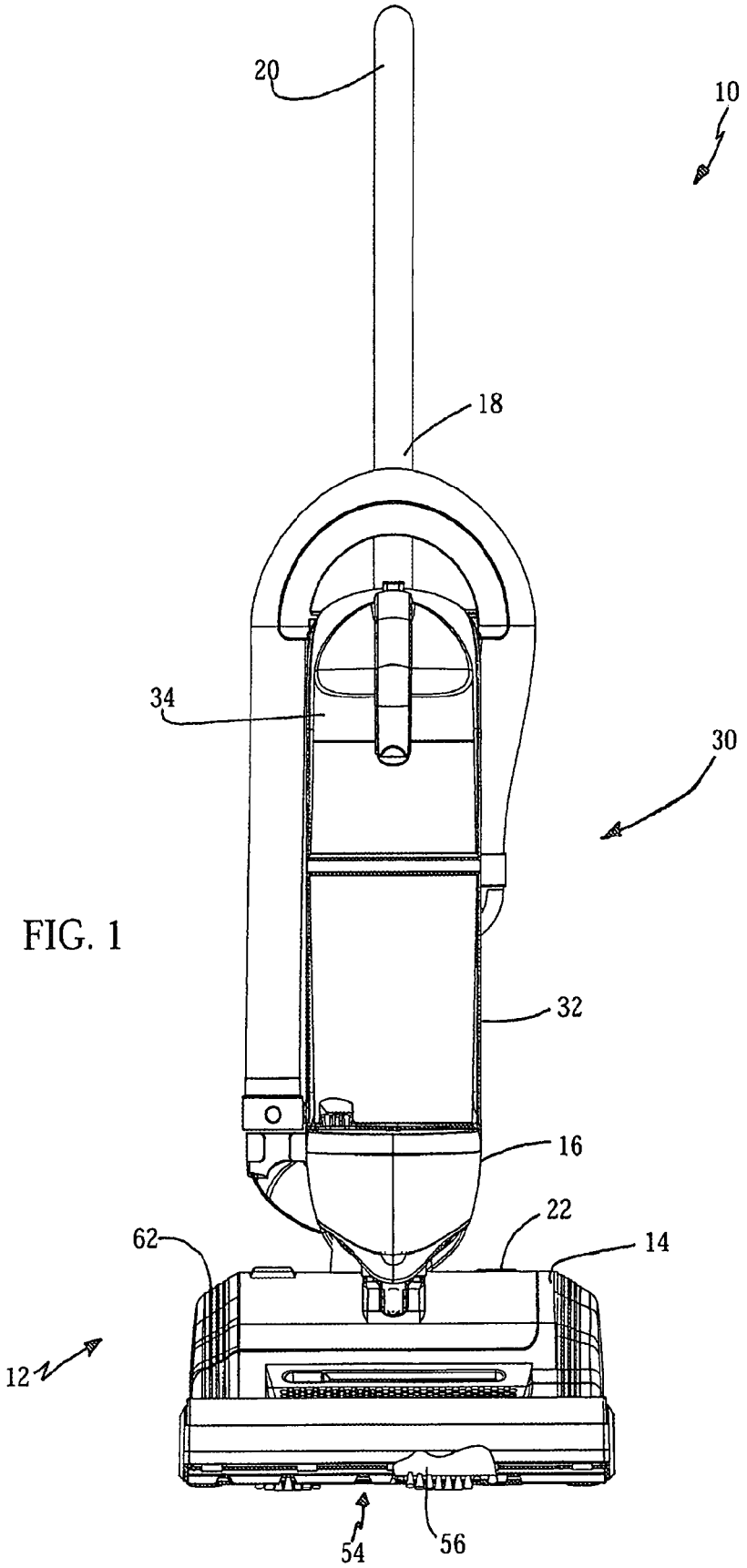
FIG. 1 is a front plan view of one possible embodiment of a vacuum cleaner.
Figure 2:
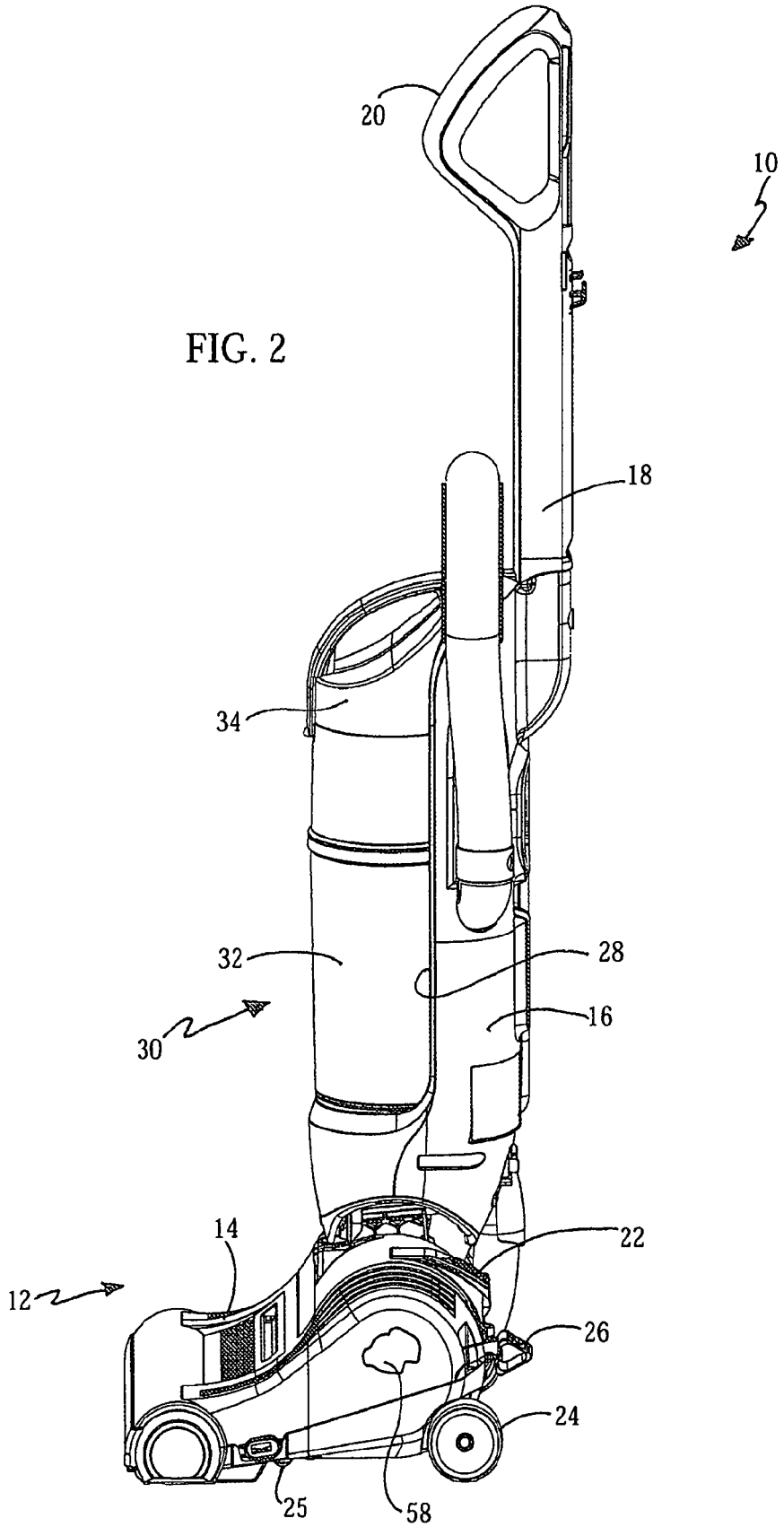
FIG. 2 is a left side elevational view of the vacuum cleaner illustrated in FIG. 1.
Figure 3:
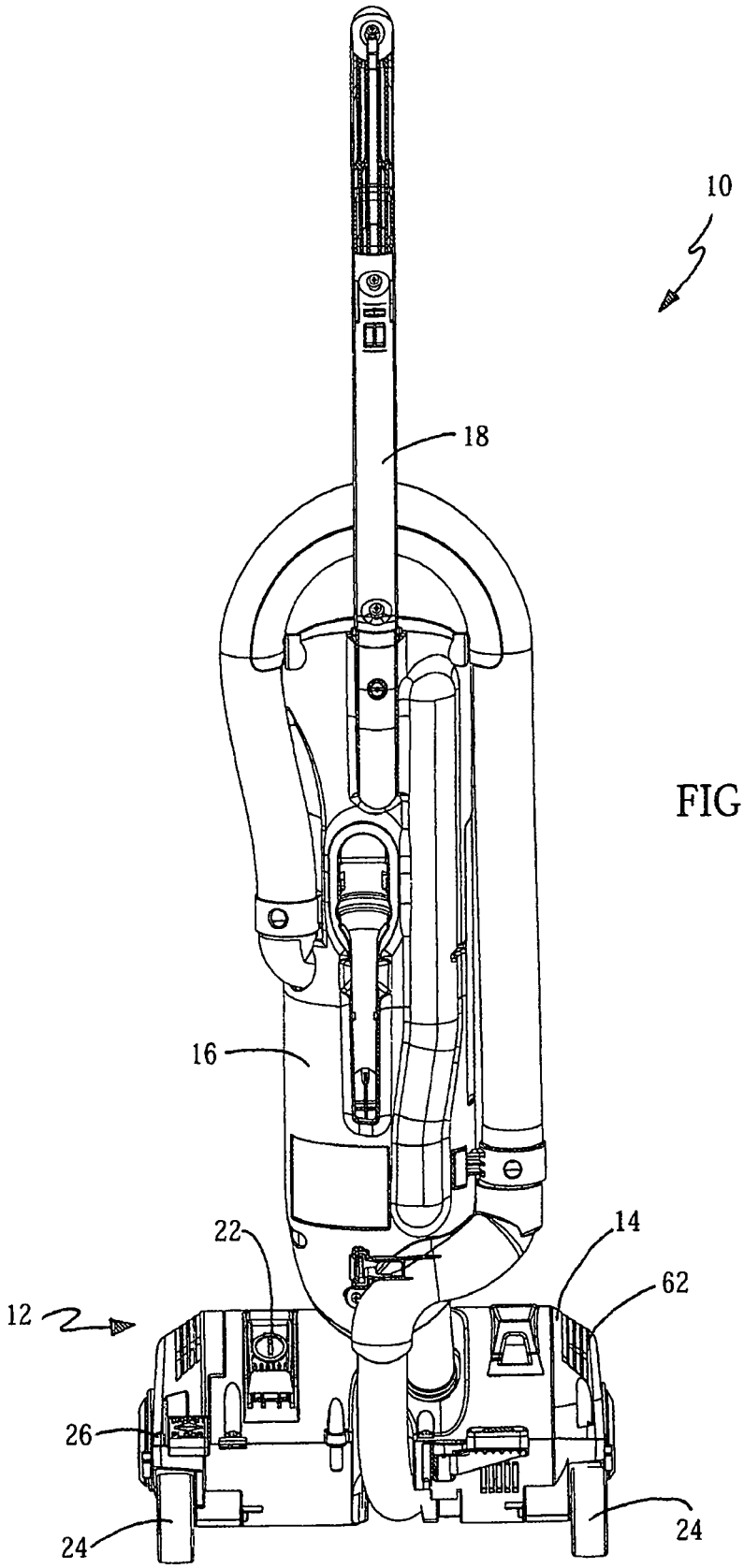
FIG. 3 is a rear elevational view of the same vacuum cleaner.

Reference is now made to FIGS. 1-3 illustrating the upright vacuum cleaner 10 of the present invention. The upright vacuum cleaner 10 has a body 12 including a nozzle assembly 14 and a handle assembly 16. The handle assembly 16 includes a control handle 18 and a handgrip 20. A control switch 22 is provided for turning the vacuum cleaner 10 on and off. Of course, electrical power is supplied to the vacuum cleaner 10 from a standard electrical wall outlet through an electrical cord (not shown). Alternatively, the vacuum cleaner 10 could be powered by battery if desired.

A pair of rear wheels 24 are provided on the lower portion of the handle assembly 16 and a pair of front wheels 25 are provided on the nozzle assembly 14. Together, these wheels 24, 25 support the vacuum cleaner 10 for movement across the floor. To allow for convenient storage of the vacuum cleaner 10, a foot latch 26 functions to lock the handle assembly 16 in an upright position as shown in FIGS. 1-3. When the foot latch 26 is released, the handle assembly 16 may be pivoted relative to the nozzle assembly 14 as the vacuum cleaner 10 is manipulated back and forth to clean the floor.

Figure 6:
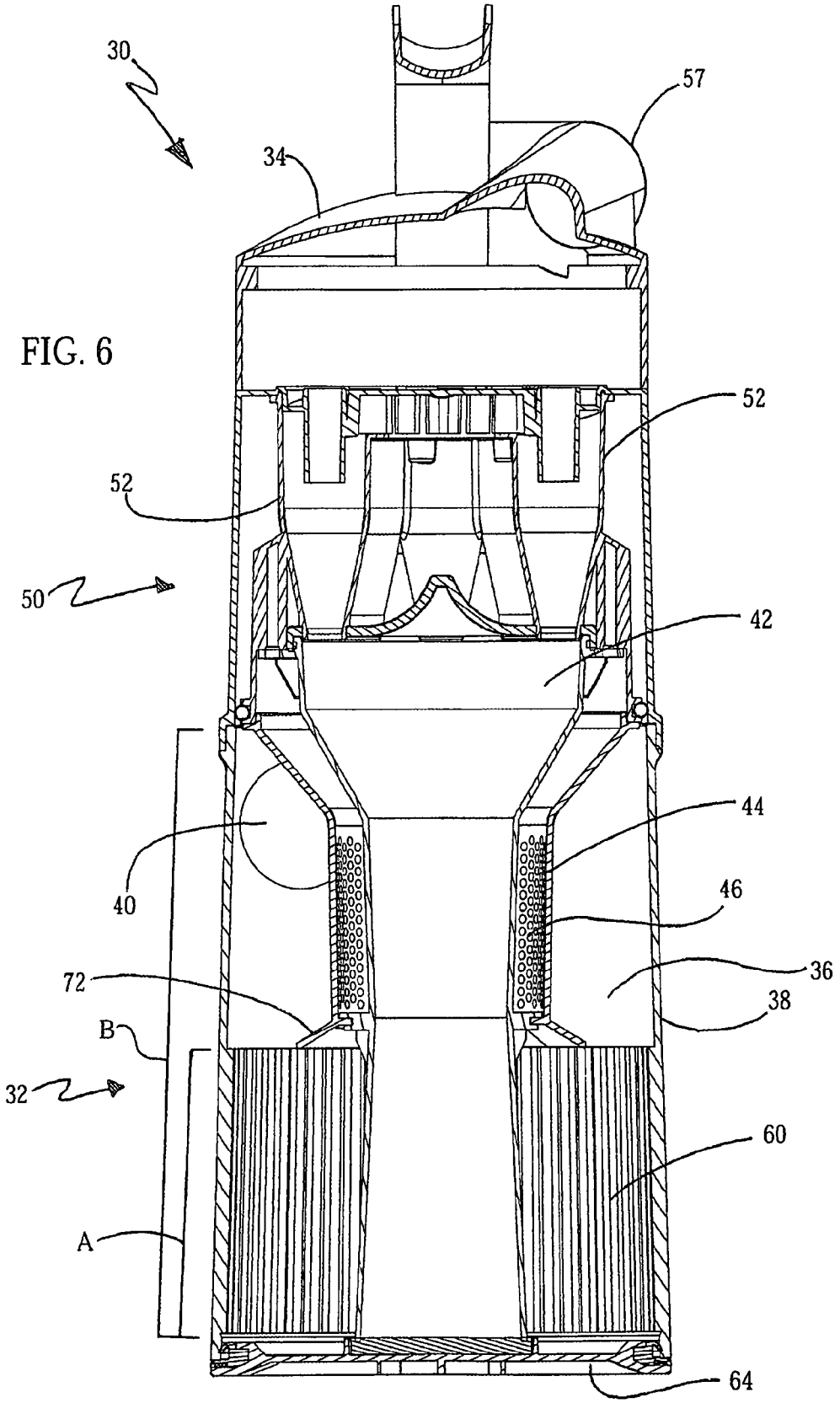
FIG. 6 is a detailed schematical side elevational view of one possible embodiment of the dirt collection vessel of the present invention.
Figure 7:
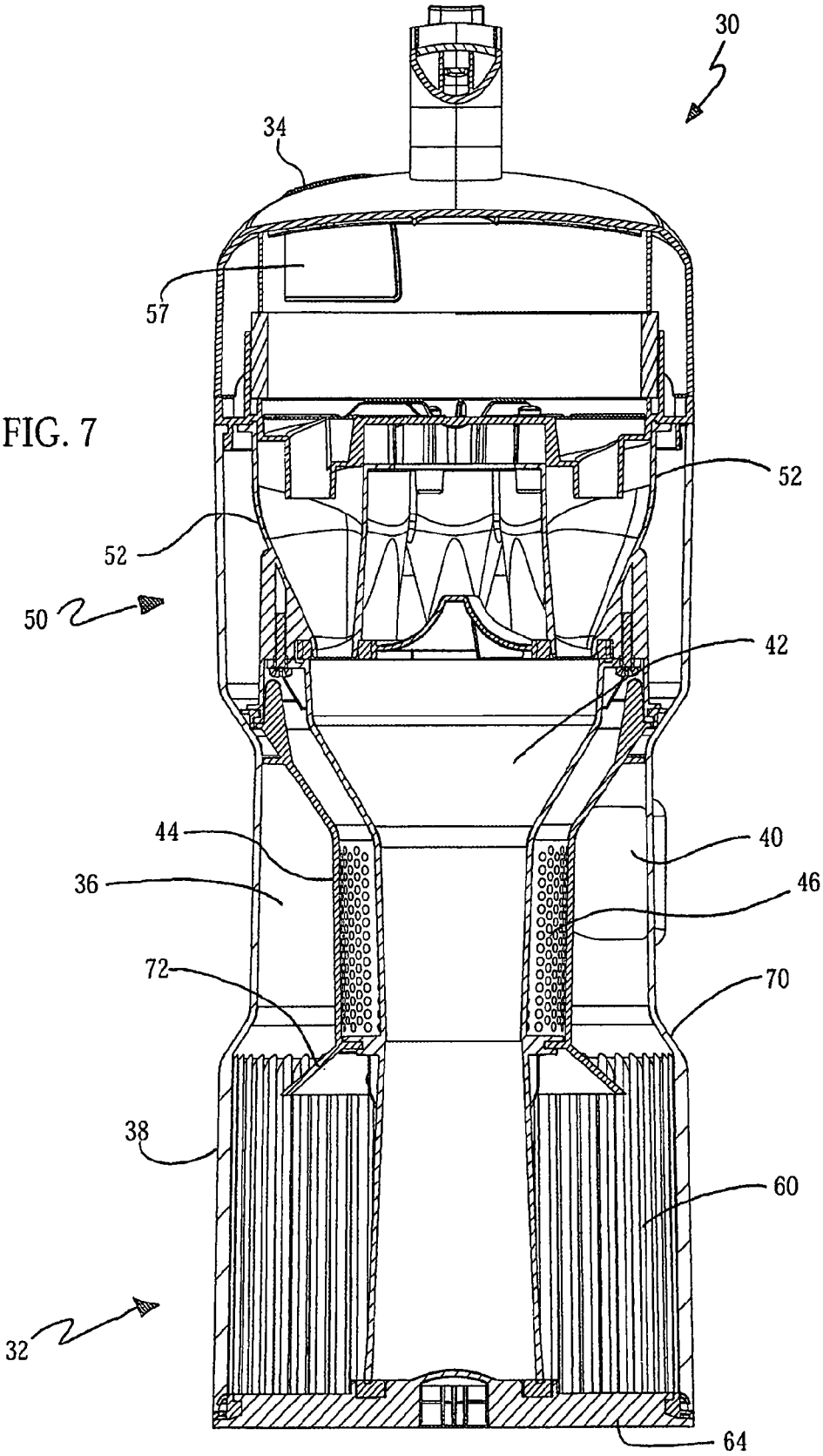
FIG. 7 is a detailed side elevational view of an alternative embodiment of a dirt collection vessel incorporating a stepped dirt cup side wall.

In the presently illustrated embodiment, the handle assembly 16 includes a dirt cup receiver 28 adapted to receive and hold the dirt collection vessel 30. As best illustrated in FIGS. 1 and 6, the dirt collection vessel 30 may take the form of a dirt cup 32 and cooperating lid 34. The dirt cup 32 includes a dirt collection chamber 36 having an arcuate sidewall 38, a tangentially directed inlet 40 and an axially directed outlet 42. A shroud 44 is provided in the dirt cup 32 over the axially directed outlet 42. The shroud 44 includes a plurality of fine apertures 46 which allow the passage of clean air yet prevent the passage of course dirt particles and debris. The shroud 44 is cylindrical in shape and concentrically received within the cylindrical sidewall 38 of the dirt cup 32. Such a structural arrangement induces cyclonic airflow in the dirt cup 32 forming a primary cyclone that provides for enhanced cleaning efficiency.

As will be described in greater detail below, the dirt collection vessel 30 also includes a secondary cyclone generally designated by reference number 50. The secondary cyclone 50 comprises multiple vortex chambers 52 that are provided in parallel. The secondary cyclone 50 generally removes substantially any fine particles remaining in the air stream after it passes through the shroud 44.

The nozzle assembly 14 includes a suction inlet 54. A rotary agitator 56 is carried on the nozzle assembly 14 so as to extend across the suction inlet 54. A suction generator 58, including a fan and a cooperating drive motor, is carried on the handle assembly 16. The suction generator 58 functions to generate a vacuum air stream for drawing dirt and debris from the surface to be cleaned. The rotary agitator 56 is connected by power take off to the motor of the suction generator 58. While the suction generator 58 is illustrated as being carried on the handle assembly 16, it should be appreciated that, alternatively, it could be carried on the nozzle assembly 14 if desired.

During normal vacuum cleaner operation, the rotary agitator 56 is driven by the motor of the suction generator 58 and functions to beat dirt and debris from the nap of an underlying carpet. The suction generator 58 simultaneously functions to draw a vacuum air stream into the suction inlet 54. Dirt and debris from the carpet is entrained in the air stream, which is then drawn by the suction generator 58 into the dirt cup 32 of the dirt collection vessel 30. Dirt and debris is captured in the dirt collection chamber 30 of the dirt cup 32 while relatively clean air is drawn through the shroud 44. That air stream then passes through the secondary cyclone or fine particle filter 50 before being exhausted through the dirt collection discharge outlet 57 and then passing over the motor of the suction generator 58 to provide cooling. The air is then exhausted through a final filter (not shown), such as a HEPA filter, before being exhausted through an exhaust port 62 into the environment.

As illustrated in FIGS. 4*a*-4*d*, 5*a*, 5*b* and 6-8, ribbing 60 is provided along the inside surface of the arcuate or cylindrical sidewall 38 of the dirt cup 32. As illustrated in FIG. 6, the ribbing may extend upwardly from the bottom wall 64 of the dirt cup 34 to a point even with the bottom of the filter skirt 66 (note area delineated by "A"). Alternatively, the ribbing 60 may extend from the bottom wall 64 of the dirt cup 32 to the top of the dirt cup (note area delineated by "B"). Of course, other ribbing arrangements are possible.

Figure 4A:
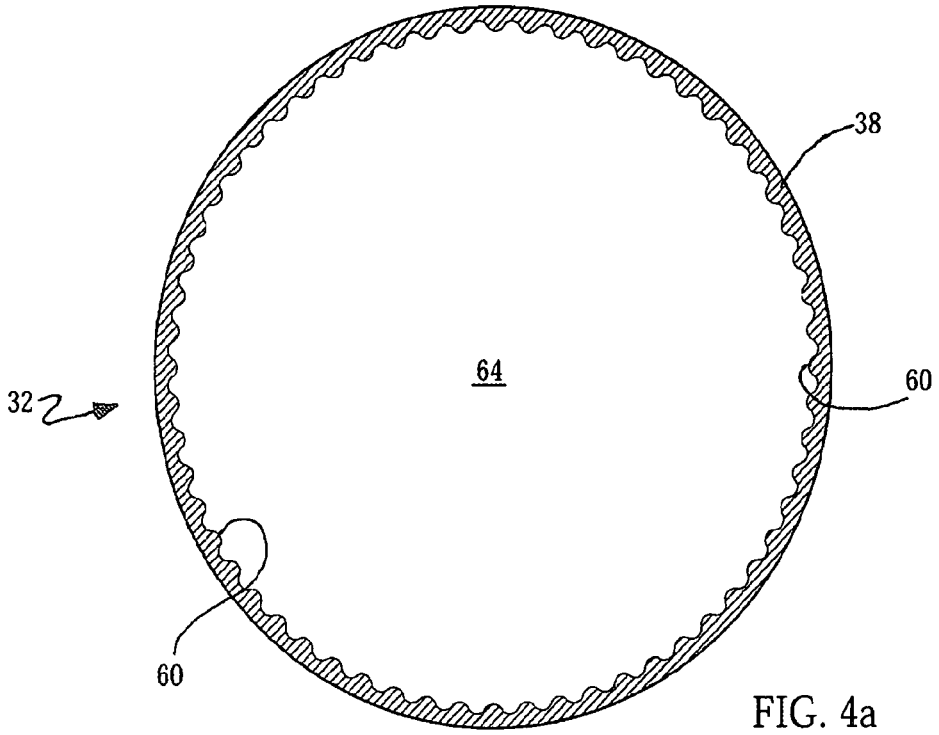
FIGS. 4*a*-4*c* comprise three schematical diagrams all illustrating vertical ribbing and FIG. 4*d* is a schematical diagram illustrating horizontal ribbing.
Figure 4B:
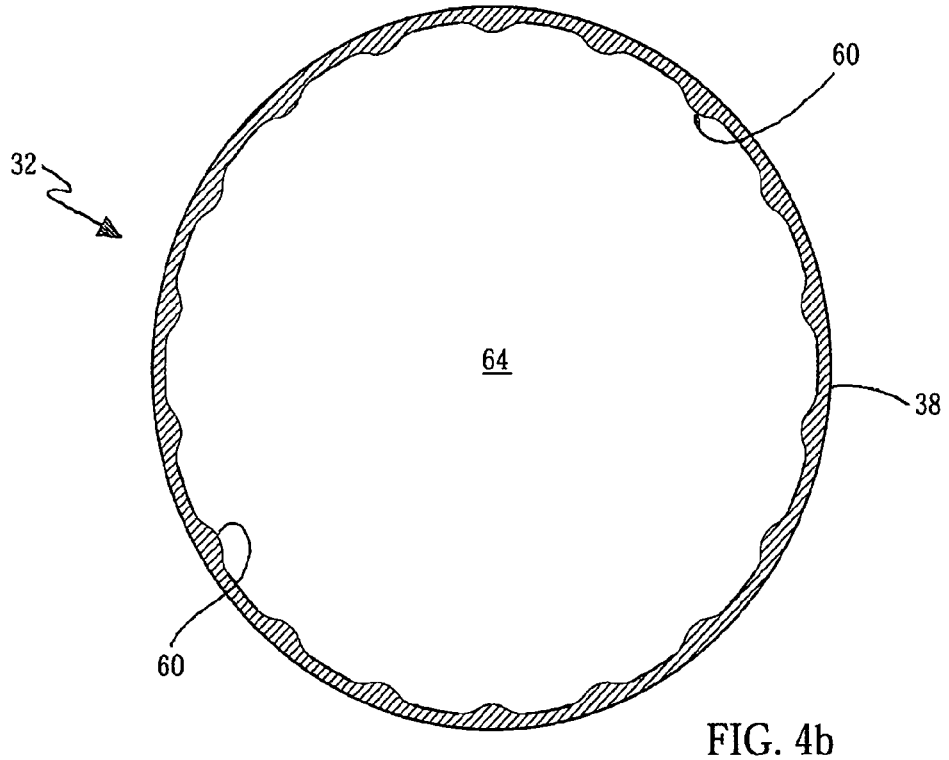
Figure 4C:
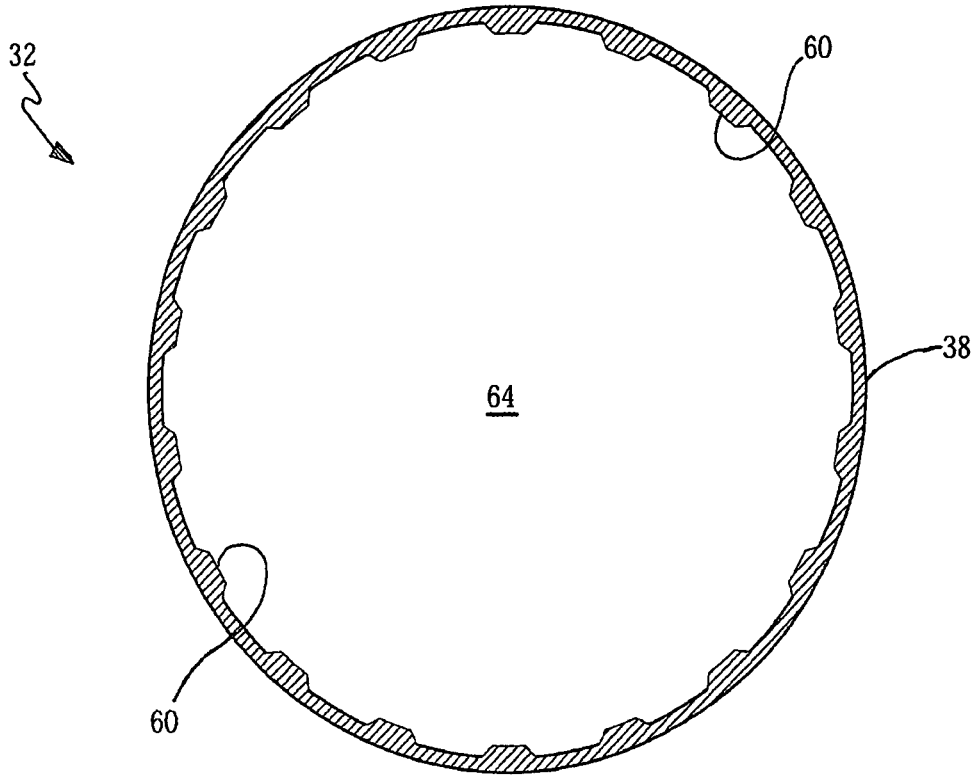
Figure 4D:
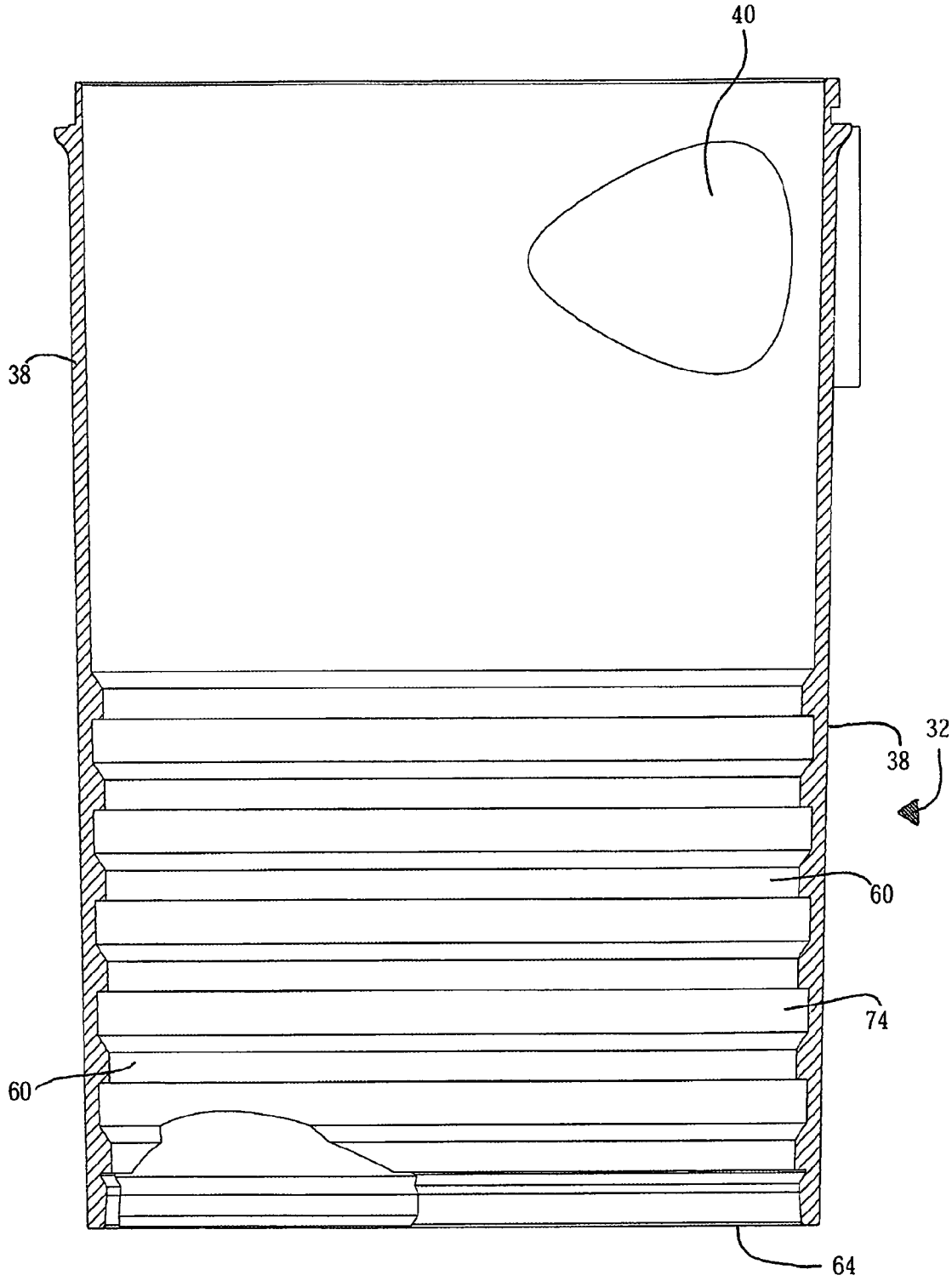
Figure 5A:
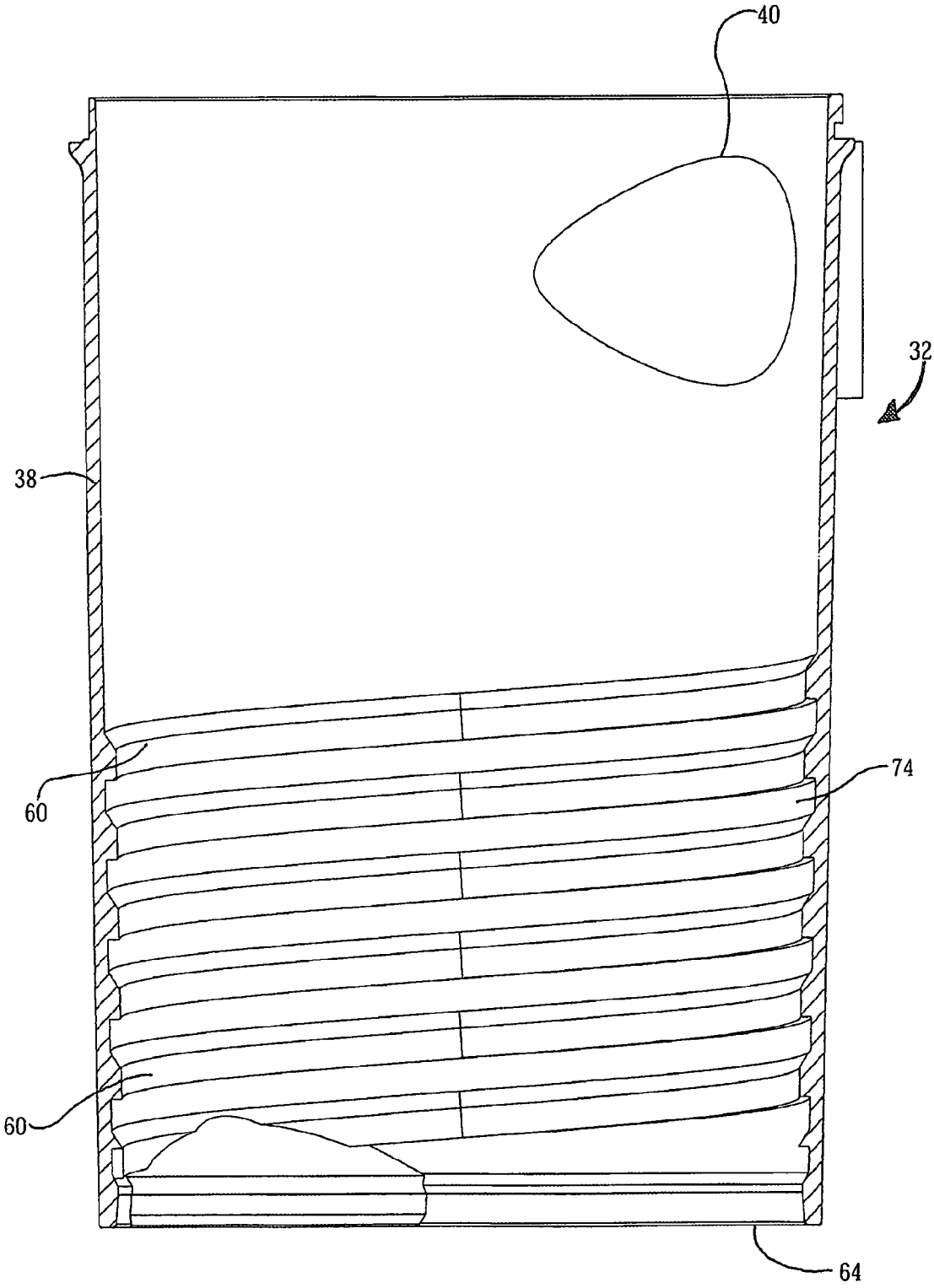
FIGS. 5*a* and 5*b* are schematical views of a dirt cup assembly illustrating helical ribbing.
Figure 5B:
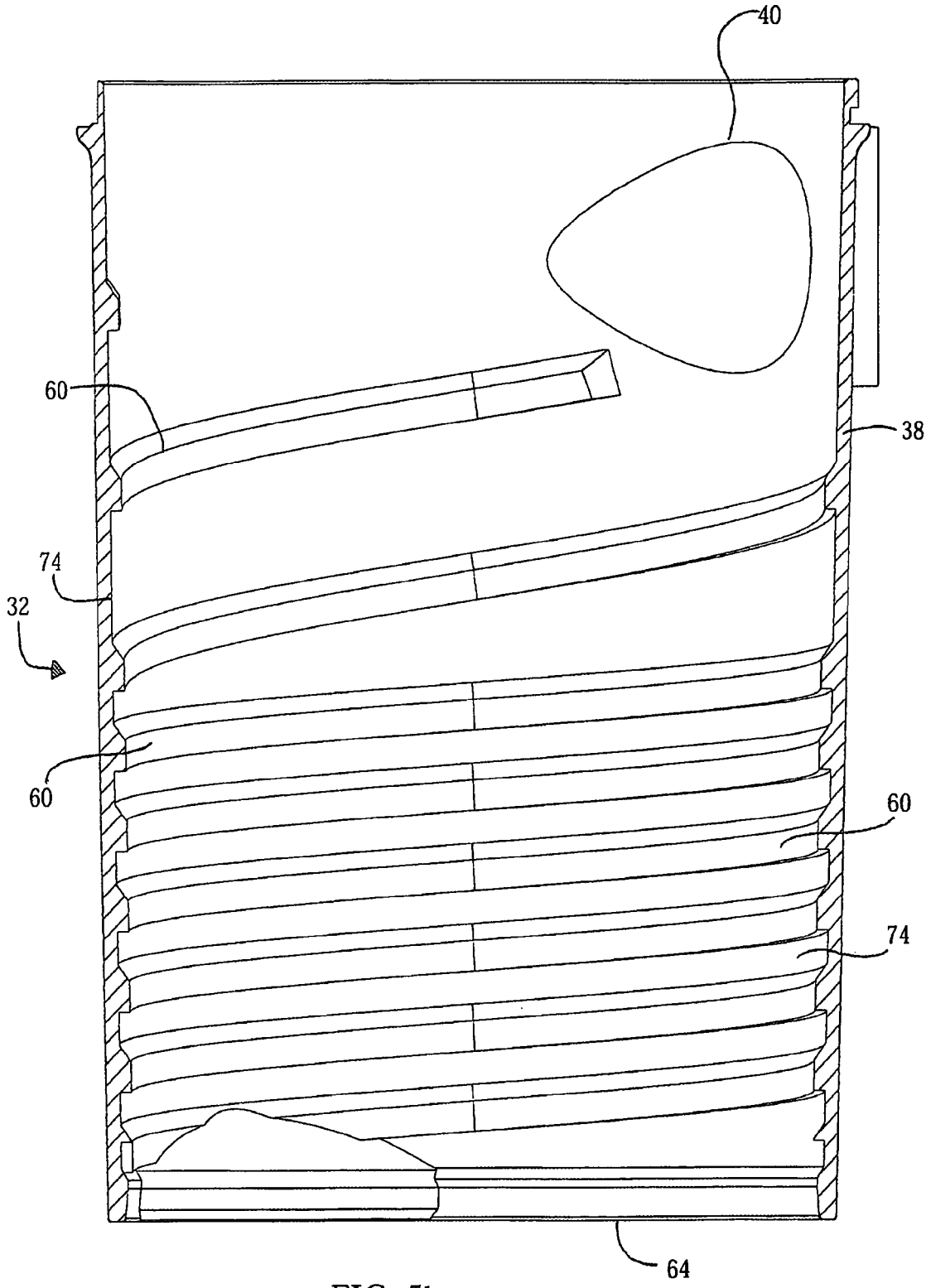

As illustrated in FIGS. 4*a*-4*c* the ribbing 60 may extend vertically: that is, substantially perpendicular to the bottom wall 64 of the dirt cup 32. Alternatively, as illustrated in FIG. 4*d* the ribbing 60 may extend horizontally: that is, parallel to the bottom wall 64 of the dirt cup 32. As illustrated in FIGS. 5*a* and 5*b*, the ribbing may also extend helically, spiraling downwardly in the direction of air flow from the inlet 40 toward the bottom wall 64 of the dirt cup 32. In FIG. 5*b*, the channel 74 provided between the rib 60 is wider at the top near the inlet 40 and gradually narrows until a point adjacent the skirt 72. From that point until the bottom wall 64, the channel 74 is approximately the same width.

In the embodiment illustrated in FIG. 6, the side wall 38 is continuous. In contrast, in an alternative embodiment illustrated in FIG. 7, the arcuate or cylindrical side wall 38 includes a step 70. The step 70 may be provided at a point along the side wall 38 substantially opposite the skirt 72 at the bottom of the shroud 44. the ribbing 60 may extend from the step 70 to the bottom wall 64 or from the inlet 40, past the step 70 to the bottom wall 64. In one possible embodiment, the helical ribbing 60 is provided above the step 70 and vertical ribbing 60' is provided below the step. Thus, it should be appreciated that different areas of the interior surface of the sidewall 38 may be provided with different types, sizes or profiles of ribbing.

Figure 8:
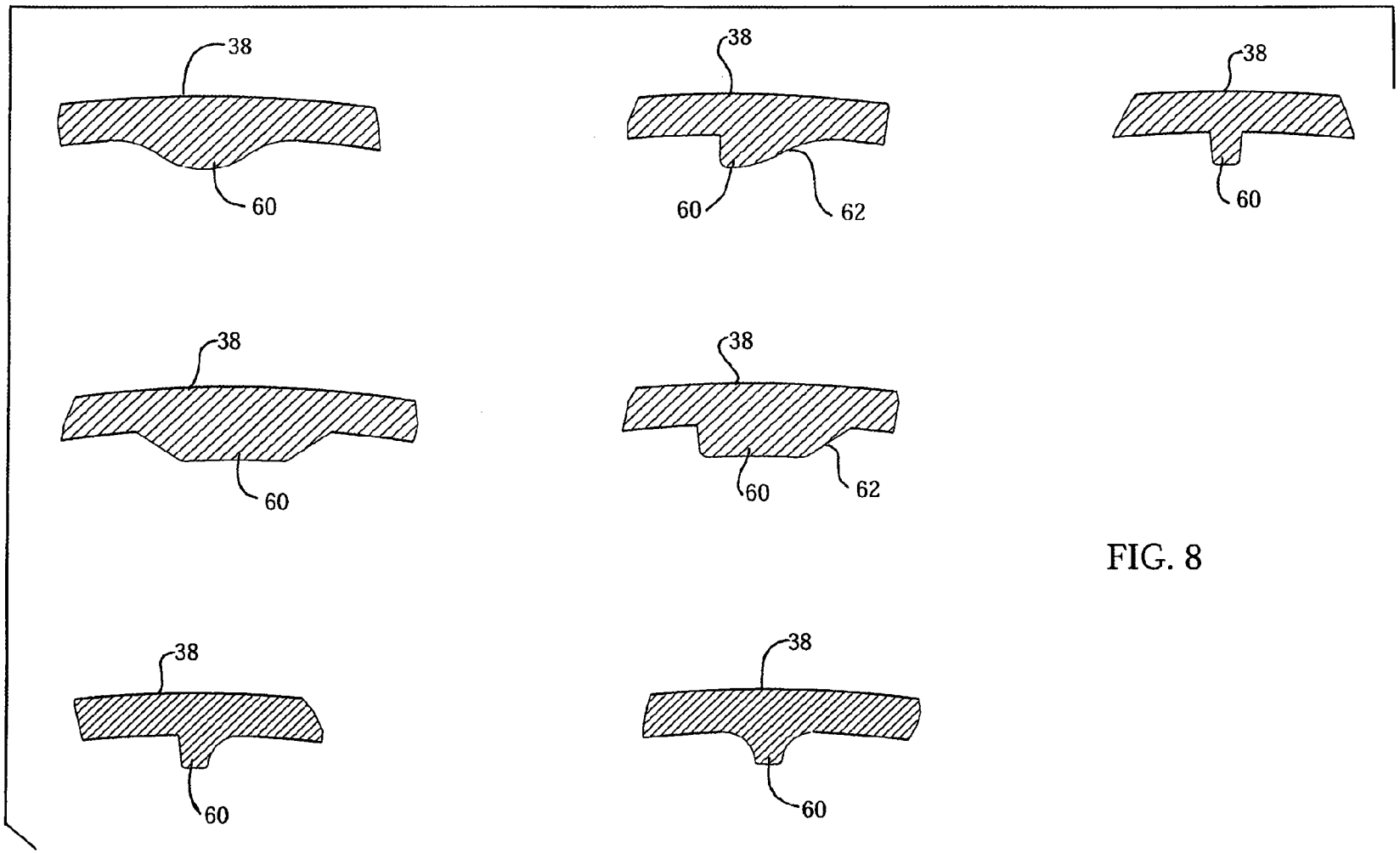
FIG. 8 is a detailed cross sectional view illustrating seven different profiles for ribs provided along the inner surface of the dirt cup side wall such as illustrated in either of FIGS. 4 and 5.

As illustrated in FIG. 8, various rib 60 profiles may be provided including, but not limited to, wave shape, curl shape, wall shape, plateau shape and cove shape. Typically the surfaces of the rib 60 are smooth. The rib 60 may also have a sloped leading edge 62 (relative to air stream flow) forming an angle with the side wall 38 of between approximately 30 and 60 degrees.

Each rib 60 may have a height of between about 0.5 and about 3.0 mm. The ribs 60 may have a spacing between ribs of between about 1.0 and about 25 mm. Further, the rib spacing to rib height ratio is typically between 3.0 to 15.0. In addition, the channels 74 formed between the ribs 60 have a cross sectional area of between about 13 and about 50 $mm^2$. Advantageously, the ribbing 60 functions to increase the performance and cleaning efficiency of the vacuum cleaner 10 by better separating dirt and debris from the air stream.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A vacuum cleaner, comprising:

a body including a nozzle assembly and a handle assembly;

a suction generator carried on said body; and a dirt collection vessel carried on said body said dirt collection vessel including a dirt cup having a sidewall and a bottom wall, a tangentially directed inlet in said sidewall and an axially directed outlet;

a shroud covering said axially directed outlet, said shroud being concentrically received within said sidewall and including a skirt; and helical ribbing extending in an arc on an inside surface of said sidewall between said tangentially directed inlet and said bottom wall so that said skirt and said helical ribbing intersect at a plane extending from opposite sides thereof.

2. The vacuum cleaner of claim 1, wherein said ribbing extends parallel to said bottom wall.

3. The vacuum cleaner of claim 1, wherein said ribbing extends perpendicular to said bottom wall.

4. The vacuum cleaner of claim 1, wherein said ribbing has a cross sectional profile of a wave shape.

5. The vacuum cleaner of claim 1, wherein said ribbing has a cross sectional profile of a curl shape.

6. The vacuum cleaner of claim 1, wherein said ribbing has a cross sectional profile of a wall shape.

7. The vacuum cleaner of claim 1, wherein said ribbing has a cross sectional profile of a plateau shape.

8. The vacuum cleaner of claim 1, wherein said ribbing has a cross sectional profile of a cove shape.

9. The vacuum cleaner of claim 1, wherein said helical ribbing has a leading edge forming an angle with said sidewall of between about 30 degrees and about 60 degrees.

10. The vacuum cleaner of claim 1, wherein said helical ribbing has a height of between about 0.5 mm and about 3.0 mm and a spacing between ribbing of about 1.0 mm and about 25 mm.

11. The vacuum cleaner of claim 1, wherein said helical ribbing has a ratio of rib spacing to rib height of between about 3.0 and about 15.0.

12. The vacuum cleaner of claim 1, wherein channels are formed between individual ribs of said ribbing, said channels having a cross sectional area of between about 13 and about 50 $mm^2$.

13. The vacuum cleaner of claim 1, wherein said sidewall includes a step at said point opposite said skirt.

14. The vacuum cleaner of claim 13, wherein said ribbing is provided below said step.

15. The vacuum cleaner of claim 13, wherein said ribbing is provided above said step.

16. The vacuum cleaner of claim 13, wherein said ribbing is provided above and below said step.

17. The vacuum cleaner of claim 13, wherein helical ribbing is provided above said step and ribbing is provided perpendicular to said bottom wall below said step.

* * * * *